US006602835B2

(12) United States Patent
Schmeida et al.

(10) Patent No.: US 6,602,835 B2
(45) Date of Patent: Aug. 5, 2003

(54) COMPOSITION AND METHOD FOR CLEANING, PROTECTING AND RESTORING VEHICULAR SURFACES

(75) Inventors: Michael Schmeida, Stow, OH (US); Brian Sokol, Westlake, OH (US)

(73) Assignee: Pennzoil-Quaker State Company, Houston, TX (US)

( * ) Notice: Subject to any disclaimer, the term of this patent is extended or adjusted under 35 U.S.C. 154(b) by 0 days.

(21) Appl. No.: 10/210,751

(22) Filed: Jul. 31, 2002

(65) Prior Publication Data

US 2003/0004078 A1 Jan. 2, 2003

Related U.S. Application Data

(63) Continuation of application No. 09/875,662, filed on Jun. 6, 2001, now abandoned.

(51) Int. Cl.[7] ..... C11D 17/00

(52) U.S. Cl. ..... 510/202; 510/203; 510/205; 510/206; 510/208; 510/211

(58) Field of Search ..... 510/202, 203, 510/189, 205, 206, 208, 211

(56) References Cited

U.S. PATENT DOCUMENTS

| | | | | | |
|---|---|---|---|---|---|
| 4,013,475 | A | * | 3/1977 | Liebowitz et al. | 3/197 |
| 4,732,612 | A | * | 3/1988 | Steer et al. | 106/10 |
| 5,017,222 | A | * | 5/1991 | Cifuentes et al. | 106/10 |
| 5,700,312 | A | | 12/1997 | Farsnight et al. | |
| 5,945,474 | A | * | 8/1999 | Gaultier | 524/546 |

* cited by examiner

*Primary Examiner*—Necholus Ogden
(74) *Attorney, Agent, or Firm*—Jenkens & Gilchrist, P.C.

(57) ABSTRACT

The invention relates to a composition and method for cleaning, protecting and restoring surfaces, particularly for vehicles such as automobiles and boats. The composition includes wax, an emulsifier, water, organic solvent and silicone liquid.

24 Claims, No Drawings

COMPOSITION AND METHOD FOR CLEANING, PROTECTING AND RESTORING VEHICULAR SURFACES

PRIOR RELATED APPLICATIONS

This application is a continuation application of U.S. application Ser. No. 09/875,662, filed on Jun. 6, 2001 now abandoned which is incorporated by reference in it's entirety herein.

FEDERALLY SPONSORED RESEARCH STATEMENT

Not Applicable.

REFERENCE TO MICROFICHE APPENDIX

Not Applicable.

FIELD OF THE INVENTION

The present invention relates to a composition and method for cleaning, restoring and protecting different types of both internal and external surfaces found in most boats, automobiles and other vehicles.

BACKGROUND OF THE INVENTION

The vast majority of automobiles, trucks, buses, vans and other vehicles, such as recreational vehicles, motor bikes and boats, include metal body panels whose exterior surfaces are coated with paint. Many such vehicles also include metal bumpers and/or trim usually plated with chrome or other bright, silvery metal. Many such vehicles also include additional body panels or parts made from vinyl, other plastics and fiberglass. The external surfaces may be embossed or molded with a pattern. Vehicles also include glass parts, such as light fixtures, mirrors and windows.

As a vehicle ages, the finish on the vehicle's external surfaces often becomes dull and unattractive. This is due to various causes including wind, weather, sunlight, scratching, rust, exudation of plasticizer from polymers, abrasion from dirt and/other materials, paint degradation through oxidation, and other physical and chemical reactions.

Many of these automobiles, trucks, buses and other vehicles on the road today also include various interior surfaces which also can become soiled, dull and unattractive. Such surfaces include leather, vinyl, colored plastic, windows and chrome. This is also due to various causes including sunlight, scratching abrasion from dirt and/other materials. Vehicles have many interior and exterior surfaces of a variety of materials.

Many products are available today for protecting external and internal automobile surfaces from these adverse effects. These products are referred to hereinafter as "auto finish-treating products". Many of these products will also restore older finishes from a dull, weathered "look" to a like-new condition.

For example, conventional car waxes are often used to protect the attractive, bright, shiny appearance of new car paint finishes. Waxes will also restore paint finishes which have become dulled over time to a like-new condition. Typically, conventional car waxes contain a wax, such as carnauba wax, dissolved in an organic solvent or dispersed in water.

Products are also available for protecting and restoring auto finishes based on vinyl and other polymers. For example, various formulations based on silicone, i.e. liquid dimethylpolysiloxanes, are widely used for restoring and protecting vinyl and other plastic parts of automobiles, trucks, buses and so forth. Other products are also available for protecting external metal parts such as bumpers and trim.

Most automotive treatment products are use-specific in the sense that they can be used only on one type of surface. For example, although waxes are effective in protecting and restoring automobile paint finishes, they do not work well on most vinyl surfaces. This is because wax clogs the surface indentations creating the roughened surface appearance of the vinyl finish, which in turn detracts rather than enhances the surface appearance of the finish. Polishing agents in the wax only make the problem worse, since they are even more visible than the wax itself.

A common feature of practically all wax-containing auto finish-treating products is that they require significant rubbing and/or buffing to be effective. This is not only time-consuming but also requires significant physical effort. Accordingly, a need also exists for a new auto finish-treating product which can be applied very easily, by simply wiping or other application method, without the rubbing or buffing steps normally required with conventional wax-containing products.

In the same way, auto surface-treating products formulated for use on vinyl and other polymer-based parts are not effective on paint, glass, rubber or metal finishes, while products useful on paint finishes may not be effective on metal, rubber, vinyls or other plastic finishes. In addition, auto surface-treating products formulated for use on exterior polymer-based parts are not effective on surfaces found in the interior portion of an automobile, such as leather, colored plastic, chrome or glass surfaces. Likewise, products used to treat interior surfaces of automobiles, such as leather, are not effective on exterior automobile surfaces, such as paint or metal finishes.

In addition to being use-specific, the products do not clean the surfaces. Accordingly, there is a need for a new auto product which can be used to clean, restore and protect all types of finishes, including paint, metal, vinyl, colored plastics, leather, rubber, plastics, fiberglass, glass and other surfaces previously discussed.

SUMMARY OF THE INVENTION

The present invention provides a novel composition and method for use of the composition in cleaning, protecting and restoring both the internal surfaces and the external surfaces of automobiles, trucks, buses, other on-road vehicles, recreational vehicles and boats. The term "vehicle" as used herein will encompass all on- and off-read vehicles and boats as discussed herein. The composition is a mixture of a wax in a water/organic solvent emulsion also containing silicone. In accordance with the invention, it has been found that this composition can be effectively applied by simple wiping without rubbing or buffing. In addition, it has been further found that this composition, when so applied, will restore the bright, shiny appearance of almost all types of external and internal automobile surfaces which have become dulled and unattractive over time, including paint, vinyl and other plastics, rubber, glass, leather and metal, and in addition will form protective coatings providing additional protection against further damage of these surfaces. When discussing external or internal surfaces, all possible surfaces used inside and outside vehicles are contemplated.

The method of use of the present invention provides simplicity to the time intensive task of cleaning, preserving and protecting interior and exterior surfaces of a motor vehicle. The novel composition need only be sprayed on the affected surfaces which are desired to be cleaned and protected. The composition is then wiped off with the use of a clean cloth or sponge. The surface is cleaned, restored and protected with one application.

Thus, the present invention provides a novel surface-cleaning and treating composition which is universal in its application in that it can be used on different surfaces, both inside and outside the automobile, including paint, metal, glass, rubber, leather, vinyl, and other plastics.

The inventive composition, therefore, can replace the up to six or more different products normally needed for cleaning, protecting and restoring all external surfaces on a modern automobile or other vehicle. Moreover, because the inventive composition need not be rubbed or buffed, it is far easier to use than conventional waxes whether or not containing added polishing agents.

BRIEF DESCRIPTION OF THE DRAWINGS

Not applicable

DETAILED DESCRIPTION

The invention is a cleaner, protectant and restorative composition that comprises micronized wax mixed in a water/organic solvent emulsion also containing silicone emulsified in the liquid phase and the method of using the composition. The composition can be used on the interior and exterior of vehicles to clean and restore the surfaces.

One of the components of the cleaner, protectant and restorative composition is a micronized wax. Wax usually refers to a substance that is a plastic solid at ambient temperature and becomes a low viscosity liquid upon being subjected to moderately elevated temperatures. Suitable waxes include any wax which undergoes a phase transition from opaque or substantially opaque to transparent or substantially transparent. In some embodiments, paraffin wax with at least 20 carbon atoms per molecule (hereinafter "$C_{20+}$ paraffin wax") is used. $C_{20+}$ paraffin wax refers to a wax composed of mainly paraffins with 20 or more carbon atoms per molecule. In other words, the $C_{20+}$ paraffin wax is substantially free of paraffins with less than 20 carbon atoms per molecule. Nevertheless, a small amount of paraffins with less than 20 carbon atoms per molecule may be present in the $C_{20+}$ paraffin wax. Preferably, the melting point of the $C_{20+}$ paraffin wax should fall in the range of about 100° F. to about 200° F. (i.e., about 37° C. to about 93° C.), more preferably in the range of about 100° F. to about 170° F., and most preferably in the range of about 110° F. to about 125° F.

Paraffin wax is considered as a petroleum wax. It typically is macrocrystalline and brittle. Paraffin wax usually is composed of about 40 to about 90 weight percent of normal alkanes, with the remainder isoalkanes and cycloalkanes. Preferably, the paraffin wax does not include a substantial amount of hydrocarbons with less than 20 carbon atoms per molecule. Typical properties of paraffin wax are listed in Table 1 as follows

TABLE I

| Typical Properties of Paraffin Wax | |
|---|---|
| FLASH POINT, CLOSED CUP ° C. | 204° |
| VISCOSITY AT 98.9° C., $MM^2/S$ | 4.2–7.4 |
| MELTING RANGE, ° C. | 46–68 |

TABLE I-continued

| Typical Properties of Paraffin Wax | |
|---|---|
| REFRACTING INDEX AT 98.9° C. | 1.430–1.433 |
| NUMBER AVERAGE MOLECULAR WEIGHT | 350–420 |
| CARBON ATOMS PER MOLECULE | 20–36 |
| DUCTILITY/CRYSTALLINITY OF SOLID WAX | friable to crystalline |

*value is a minimum

Typical waxes for use in this composition are carnauba, granular beeswax and powdered. Also, polyethylene waxes can be used. Also, a carnauba wax emulsion could be used such as Challenge Carnauba 30 made by Challenge, Inc.

When wax is applied to a painted automobile surface the wax forms a protective coating which develops a desired shiny appearance due to the surface smoothness of the applied coating. The protectant and restorative composition provides a simple application for the wax that does not require vigorous buffing to improve the appearance of smooth surfaces such as painted or chrome surfaces of a vehicle.

The wax can also include polishing agents, i.e. particulate abrasives, which abrade away surface irregularities in older vehicles thereby facilitating formation of a smooth wax coating.

In one embodiment of the present invention, micronized waxes are used as opposed to conventional waxes. Micronized waxes are waxes which have been cryogenically ground to extremely fine particle sizes on the order of 3 to 20 microns. Most waxes including soft waxes become brittle when cooled to very low temperatures. In this condition, the waxes can be ground to extremely fine particle sizes and recovered either in powder form or in the form of dispersions in aqueous or organic liquids.

Micronized waxes are used primarily for providing lubricity and water-repellency in paints, stains, inks and other coatings. They are available commercially both in powdered form and in the form of dispersions in a liquid carrier including both water and organic solvents. In accordance with the present invention, micronized waxes are used as a primary component of the inventive compositions for providing smooth, shiny protective coatings on all types of finishes including paint, metal vinyl and other plastics.

The average particle size of the micronized waxes used in the present invention can vary widely and essentially any average particle size can be used. Thus, average particle sizes on the order of 3 to 20 microns are useful.

The type of wax used to make the micronized wax component of the inventive compositions can also vary widely. Micronized waxes available commercially are made from a wide variety of different waxes, and any such micronized was product can be used in accordance with the present invention. For example, micronized waxes made from natural waxes such as carnauba wax can be used. Specific examples of commercially available micronized waxes useful in the present invention are the series of micronized waxes sold under the mark CERIDUST® by Hoechst Celanese Corporation of Somerville, N.J. and the series of micronized waxes sold under the designation AQUA BEAD® was sold by Micropowders, Inc., of Tarrytown, N.Y.

In one embodiment of the invention, mixtures of two or more different types of waxes are employed. For example, mixtures of low molecular weight polyethylene waxes and paraffin waxes are particularly suitable for use in the present invention. In a preferred embodiment of the invention, a mixture of a CERIDUST® brand wax sold by Hoechst Celanese Corporation, particularly CERIDUST® 9630F and an AQUA BEAD® wax sold by Micropowders, Inc., particularly AQUA BEAD® 916, is used.

In another embodiment of the invention, other micronized polymers can be used in addition to the wax component. In this regard, it is already known that micronized polytetrafluoroethylene (PTFE) can be used in combination with micronized waxes to achieve higher surface lubricity and anti-blocking properties in other environments. Micronized polytetrafluoroethylene can also be included in the finish-treating compositions of the present invention to increase lubricity and water repellency thereof. A preferred PTFE is MP 1150 made by DuPont. Other micronized polymers such as polyamide and the like can also be used.

The amount of wax included in the compositions can vary widely. For example, about 0.5 to about 2.50% by weight can be used. Also, if an additional micronized polymer such as PTFE is included in the system, the amount of this component present can be on the order of 0.05 to 2.50% based on the total weight of the composition.

The organic solvent used in forming the liquid carrier can be selected from a wide variety of commercially available materials. In this regard, because the preferred wax used in the composition is micronized, there is no need to dissolve this wax component in the organic solvent portion of the liquid carrier.

The ability of an organic solvent to dissolve various solutes, i.e. its solvency, is typically measured in terms of its Kauri-butanol value as determined by ASTM D-113. In conjunction with utilizing micronized wax, organic solvents having a Kauri-butanol value of no higher than about 45 are employed. Such organic solvents should also have a relatively low vapor pressure, i.e. on the order of no higher than about 6 mm Hg at 20° C.

Many different commercially available organic solvents except mineral oils can be used in accordance with the present invention. For example, a range of normal paraffins, chlorinated organic solvents and synthetic isoparaffinic solvents fall within the foregoing requirements.

A preferred class of organic solvents is the synthetically produced isoparaffinic solvents available from Exxon Chemical Company under the designation Isopar®. These materials are highly aliphatic, synthetically produced organic solvents containing a high percentage (50 to 99+%) of isoparaffins and having a vapor pressure at 38 degree C. of about 100 mm Hg or less as determined by ASTM D2879, and kauri-butanol values of about 25 to 29.

Another organic solvent that can be utilized in the present invention is Type I mineral spirits or thinner, meeting ASTM D235 (Stoddard Solvent). This material is composed of roughly half paraffins and half aromatics and naphthenes and exhibits initial boiling points of roughly 140° to 170° C. (about 290° to 340° F.), final boiling points of no higher than about 205° C. (about 400° F.) and solvencies, measured as kauri-butanol values, of approximately 25 to 45.

Specific examples of organic solvents useful in the present invention are Isopar® M, Isopar® V and odorless mineral spirits discussed above.

The amount of organic solvent to be included in the inventive compositions can also vary widely. Typically, the inventive finishing compositions will contain about 8 to about 35% organic solvent, by weight. Both the amount and volatility of the organic solvent play a role in determining how long the inventive composition can be exposed to the atmosphere before it can no longer be used. Accordingly, the identity and amount of solvent should be selected to ensure that the working time of the inventive composition is sufficient for its intended use The other component of the liquid carrier of the composition is water. De-ionized water may be used. The amount of water that can be used in the inventive compositions can vary widely from about 55% to about 85%. It is desirable, however, to limit the water content of the compositions so that physical properties of the resulting composition will have a viscosity preferably between 5000–9000 centipoise, although a greater range of viscosity can also be used.

An additional component of the protectant and restorative composition is silicone. A wide variety of silicone liquids are available commercially. A preferred silicone is liquid dimethylpolysiloxane. Typically, these liquids are composed substantially completely of dimethylpolysiloxane, although substituted dimethylpolysiloxane substituted with various other ingredients are also known. In accordance with the invention, any conventional dimethylpolysiloxane can be used.

Dimethylpolysiloxane liquids are typically defined by their viscosities with lower viscosity silicones being easier to spread on a surface but yielding coatings exhibiting smaller amounts of shine. In accordance with the present invention, silicone liquids having viscosities on the order of 100 to 10,000 centipoise can be employed. Also, the amount of silicone liquid included can vary widely. Amounts on the order of about 1.5 to about 15 wt. % can be used.

In this connection, there is a relationship between viscosity and amount of silicone liquid to be included in the inventive finishing compositions which is helpful to observe for proper formulation. Higher viscosity silicones are more difficult to distribute evenly on a surface, and accordingly a comparatively less amount of this type of silicone fluid should be employed. At the same time, silicone fluids which are either too low in viscosity or too low in amount will result in an insufficient shine being imparted to the surface to be treated. On the other hand, an insufficient amount of a high viscosity silicone leads to non-uniform application and hence the formation of streaks. Basically, higher amounts of higher viscosity silicones are acceptable for vinyl surfaces but will smear metal, while lower quantities of lower viscosity silicones work with metal but do not shine vinyl. Accordingly, the identity and amount of particular silicone liquid to be included in a particular inventive composition should be selected so as to achieve the desired combination of properties in terms of ease of application and degree of shine desired.

In order to form a stable system of the liquid silicone in the liquid carrier, it is also desirable to include in the inventive compositions a suitable emulsifier or emulsifiers.

The type of emulsifier to be included depends on the phase, aqueous or organic, in which it is desired for the silicone liquid to reside. If the silicone liquid is intended to remain mixed or emulsified in the organic phase, then a water-in-oil emulsifier such as Span® 80 (sorbitan monooleate) or sorbitan laureate should be used. If it is desired that the silicone liquid reside in the aqueous phase, then an oil-in-water emulsifier should be employed. Examples of suitable oil-in-water emulsifiers are morpholine oleate paired with a fatty acid such as Latol #1. The emulsifier or emulsion system is generally about 0.50 to about 2.50 wt % of the composition.

Silicone liquids are available commercially in the form of aqueous emulsions as well as neat, i.e. undiluted. In this connection, if an aqueous emulsion is used as the source of the silicone liquid, a suitable oil-in-water emulsifier may be present in the silicone emulsion so that an additional emulsifier is unnecessary. If, on the other hand, an undiluted silicone liquid is used as the source, then an emulsifier should be provided in the composition. A silicone oil suitable for use with an emulsifier is 350 centipoise silicone (Si 350). A functionalized silicone suitable for use is SM 2163 made by General Electric.

It is also possible in accordance with the present invention to include other conventional ingredients in the protectant and restorative compositions. Examples of such conventional components are dyes, colorants, fragrances, UV stabilizers, thickeners, preservatives and other additives known to those skilled in the art. Such components may have an effect on the stability of the inventive composition. Accordingly, care should be taken in using such components to ensure that appropriate types and amounts of these additional ingredients are selected and appropriate amounts of additional emulsifiers are added to account for any such effects these components might have.

Fragrance additives in effective amounts to impart a desirable scent that can be used include Technical Cherry such as TFF 148032 and TFF09004. Other fragrances such as citrus, leather, powder fresh and seagress scents can be used. These scents are supplied by Custom Essence. An anti-microbial preservative such as Nuocept C™ made by Creanova can be used. There are numerous ultraviolet stabilizers available, including Tinuvin® 1130 Tinuvin® 99 by CIBA. Fillers and thickeners such as Polygel DR made by 3V can be used to achieve the desired consistency.

EXAMPLE 1

The following Table II is exemplary of ranges of the primary components that can be used to make the composition of the present invention.

TABLE II

| Component Type | Component Amount, wt. % |
|---|---|
| Organic Solvent (excluding mineral oil) | 8–35 |
| Emulsifier/Emulsion System | 0.5–2.5 |
| Silicone | 1.5–15 |
| Wax | 0.5–2.5 |
| Water | 55–85 |

EXAMPLE 2

A protectant/restorative composition produced in accordance with the present invention was made by mixing an organic solvent, a low viscosity silicone liquid, a fragrance, a UV-inhibitor, and a fatty acid. While mixing the foregoing ingredients, two types of micronized wax were added along with a durable polymer. The resulting mixture was subjected to further vigorous mixing, until no lumps were present. Water was then added to the mixture, followed by more mixing. An emulsifier was then added while mixing. Finally, a preservative and a functionalized silicone were added to the composition and mixed for a short period of time, producing the inventive composition, with the component weights as described more fully in Table III below.

TABLE III

| Component Type | Component Identity | Component Amount, wt. % |
|---|---|---|
| Organic Solvent | low volatility isoparaffin solvent (Isopar M) | 20 |
| Emulsifier | Morpholine | 5 |
| | CAO402 Tall oil fatty | 5 |
| Silicone Liquid | 350 Centisoke Silicone Liquid | 10 |
| | 60% aqueous emulsion of 350 Centisoke Silicone (SM 2163) | 1.0 |
| Micronized Wax | CERIDUST ® 9630F | 0.5 |
| Micronized Wax | Micronized Paraffin Wax (AQUA BEAD ® 916) | 0.5 |
| Thickener | Polygel DR | 0.2 |
| Preservative | Nuocept C ™ | 0.2 |
| UV-Inhibitor | Tinuvin ® 99 | 0.1 |
| Fragrance | Technical Cherry | 0.9 |
| Water | Tap Water | 66.4 |

The product exhibited a viscosity of between 5,000 and 9,000 cps. The product had a cherry odor and a milky, off-white color. The composition further exhibited a pH of between 8.0–9.0, along with a specific gravity between 0.922–0.936.

The following are other formulations of the composition used in the method of the present invention.

EXAMPLE 3

TABLE IV

| Component Type | Component Identity | Component Amount, wt. % |
|---|---|---|
| Organic Solvent | Isopar M | 10.0 |
| | Isopar V | 10.0 |
| Silicone Liquid | SM2163 | 1.00 |
| | $S_1$ 350 | 10.0 |
| Emulsifier | Tall oil | 0.50 |
| | Morpholine | 0.50 |
| Micronized Wax | CERIDUST ® 9630F | 1.00 |
| Water | | 66.4 |
| Preservative | Nuocept C ™ | 0.20 |
| Fragrance | Leather Fresh | 0.10 |
| UV-Inhibitor | Tinuvin ® 1130 | 0.10 |
| Thickener | Polygel DR | 0.20 |

EXAMPLE 4

TABLE V

| Component Type | Component Identity | Component Amount, wt. % |
|---|---|---|
| Organic Solvent | Odorless Mineral Spirits | 3.00 |
| | Isopar V | 7.00 |
| Silicone Liquid | $S_1$ 350 | 5.00 |
| | SM 2163 | 2.50 |
| Functionalized Silicone | DC 536 | 1.00 |
| | SR 107 | 0.50 |
| | SF 1706 | 2.00 |
| Emulsifier | Span ® 80 | 1.00 |
| Micronized Wax | CERIDUST ® | 0.25 |
| | AQUA BEAD ® | 0.75 |
| Water | | 77.4 |
| UV Inhibitor | Tinuvin ® 99 | 0.10 |
| Fragrance | Sunkiss | 0.10 |

EXAMPLE 5

TABLE VI

| Component Type | Component Identity | Component Amount, wt. % |
|---|---|---|
| Organic Solvent | Isopar M | 10.00 |
| | OMS (?) | 5.00 |
| Silicone Liquid | SM 2163 | 2.00 |
| | MP1150 | 0.20 |
| PTFE | MP 1150 | 0.20 |
| Emulsifier | Span ® 80 | 1.00 |
| Wax | Challenge Carnauba 30 | 0.20 |
| Micronized Wax | CERIDUST ® 9630F | 0.50 |
| | AQUA BEAD ® 916 | 0.50 |
| Water | | 80.20 |
| Fragrance | TFF 148032 | 0.20 |
| Preservation | Miocept C | 0.20 |

EXAMPLE 6

TABLE VII

| Component Type | Component Identity | Component Amount, wt. % |
|---|---|---|
| Organic Solvent | OMS | 20.00 |
| Silicone Liquid | 350 Silicone | 10.00 |
| | SM 2163 | 1.00 |
| Emulsifier | Morpholine | 0.50 |
| | Latal #1 | 0.50 |
| Micronized Wax | AQUA BEAD ® 916 | 0.50 |
| | CERIDUST ® 9630F | 0.50 |
| Water | De-ionized Water | 66.40 |
| Thickener | Polygel DR | 0.20 |
| Fragrance | Technical Cherry | 0.10 |
| Preservative | Nuocept C ™ | 0.20 |

As mentioned above, the compositions of the present invention are applied to the surface and wiped, with no rubbing or buffing being necessary. The composition should be used out of direct sunlight for best results and in temperatures about 50° F. In the preferred method, thoroughly rinse down the exterior surface to remove loose dirt and, if necessary, cool the surface. After the loose dirt and any other materials are removed, the composition can be sprayed uniformly over all exterior surfaces, including rubber, paint, metal, plastic and glass. It is preferred, but not necessary, that the composition be applied sparingly on glass windows. After the product is sprayed on, the surface is wiped, which also removes dirt and disperses the product on the surface. Preferably, a clean cotton cloth (100% cotton can be used) or sponge is used, turning the cloth frequently, and rinsing the cloth or sponge once soiled. Afterwards, with a clean, dry, soft cloth, the surface can be polished to a shine, again turning the cloth frequently.

For interior applications, preferred use is out of direct sunlight. Spray or disburse the composition on the interior surface. Wipe the surface with a cloth or sponge as described above. The composition can be used on leather, vinyl, colored plastic, trims and chrome. The product should be used sparingly on windows and should not be used on clear plastics.

The results obtained on each surface are a cleaned, protected and/or restored finish.

Although only a few embodiments of the present invention have been described above, it should be appreciated that many modifications can be made without departing from the spirit and scope of the present invention. For example, while the inventive composition can be applied to a clean car to avoid abrasion of the surface with dirt particles, it can also be used on a lightly soiled surfaces. In this application, the product will clean both the fine dust particles from the surface and the oil based soils that have penetrated more deeply into the paint, vinyl, leather, or other areas. All such modifications are intended to be included within the scope of the present invention, which is to be limited only by the following claims.

What is claimed is:

1. A method for cleaning at least one surface of a vehicle comprising the steps of mixing the following components:

a) about 1% micronized wax, b) about 66% water, c) about 20% organic solvent, d) about 1.5% emulsifier, and e) about 10% silicone liquid, applying the cleaning mixture on an external surface of the vehicle; and wiping the cleaning mixture off the external surface of the vehicle.

2. A method for cleaning at least one surface of a vehicle of claim 1, additionally comprising the steps of:

applying the cleaning mixture on an internal surface of the vehicle; and wiping the cleaning mixture off the internal surface of the vehicle.

3. A method for cleaning at least one surface of a vehicle of claim 1, additionally comprising in the step of mixing the components adding one of the group consisting of an effective amount of a preservative, a thickener, a fragrance, an ultraviolet light inhibitor and mixtures thereof.

4. A method for cleaning at least one surface of a vehicle comprising the steps of mixing the following components:

a) about 1% micronized wax, b) about 0.2% PTFE, c) about 0.2% carnauba wax, d) about 15% organic solvent, e) about 1% emulsifier, f) about 2.2% silicone liquid, and g) about 80.4% water, applying the cleaning mixture on an external surface of the vehicle; and wiping the cleaning mixture off the external surface of the vehicle.

5. A method for cleaning at least one surface of a vehicle of claim 4, additionally comprising the steps of:

applying the cleaning mixture on an internal surface of the vehicle; and wiping the cleaning mixture off the internal surface of the vehicle.

6. A method for cleaning at least one surface of a vehicle of claim 4, additionally comprising in the step of mixing the components adding one of the group consisting of an effective amount of a preservative, a thickener, a fragrance, an ultraviolet light inhibitor and mixtures thereof.

7. A method for enhancing the appearance of at least one surface of a vehicle comprising the steps of mixing the following components:

a) about 1% micronized wax, b) about 66% water, c) about 20% organic solvent, d) about 1.5% emulsifier, and e) about 10% silicone liquid, spraying the enhancing mixture on an external surface of the vehicle; and wiping the enhancing mixture off the external surface of the vehicle.

8. A method for enhancing the appearance of at least one surface of a vehicle of claim 7, additionally comprising the steps of:

spraying the enhancing mixture on an internal surface of the vehicle; and wiping the enhancing mixture off the internal surface of a vehicle.

9. A method for enhancing the appearance of at least one surface of a vehicle of claim 7, additionally comprising in the step of mixing the components adding one of the group consisting of an effective amount of a preservative, a thickener, a fragrance, an ultraviolet light inhibitor and mixtures thereof.

10. A method for enhancing the appearance of at least one surface of a vehicle comprising the steps of mixing the following components:

a) about 1% micronized wax, b) about 0.2% PTFE, c) about 0.2% carnauba wax, d) about 15% organic solvent, e) about 1% emulsifier, f) about 2.2% silicone liquid, and g) about 80.4% water, spraying the enhancing mixture on an external surface of the vehicle; and wiping the enhancing mixture off the external surface of the vehicle.

11. A method for enhancing the appearance of at least one surface of a vehicle of claim 10, additionally comprising the steps of:

spraying the enhancing mixture on an internal surface of the vehicle; and wiping the enhancing mixture off the internal surface of the vehicle.

12. A method for enhancing the appearance of at least one surface of a vehicle of claim 10, additionally comprising in the step of mixing the components adding one of the group consisting of an effective amount of a preservative, a thickener, a fragrance, an ultraviolet light inhibitor and mixtures thereof.

13. A method for protecting at least one surface of a vehicle comprising the steps of mixing the following components:

a) about 1% micronized wax, b) about 66% water, c) about 20% organic solvent, d) about 1.5% emulsifier, and e) about 10% silicone liquid, spraying the protecting mixture on an external surface of the vehicle; and wiping the protecting mixture off the external surface of the vehicle.

14. A method for protecting at least one surface of a vehicle of claim 13, additionally comprising the steps of:

spraying the protecting mixture on an internal surface of the vehicle; and wiping the protecting mixture off the internal surface of a vehicle.

15. A method for protecting at least one surface of a vehicle of claim 13, additionally comprising in the step of mixing the components adding one of the group consisting of an effective amount of a preservative, a thickener, a fragrance, an ultraviolet light inhibitor and mixtures thereof.

16. A method for protecting at least one surface of a vehicle comprising the steps of mixing the following components:

a) about 1% micronized wax, b) about 0.2% PTFE, c) about 0.2% carnauba wax, d) about 15% organic solvent, e) about 1% emulsifier, f) about 2.2% silicone liquid, and g) about 80.4% water, spraying the protecting mixture on an external surface of the vehicle; and wiping the protecting mixture off the external surface of the vehicle.

17. A method for protecting at least one surface of a vehicle of claim 16, additionally comprising the steps of:

spraying the protecting mixture on an internal surface of the vehicle; and wiping the protecting mixture off the internal surface of a vehicle.

18. A method for protecting at least one surface of a vehicle of claim 16, additionally comprising in the step of mixing the components adding one of the group consisting of an effective amount of a preservative, a thickener, a fragrance, an ultraviolet light inhibitor and mixtures thereof.

19. A method for cleaning at least one surface of a vehicle comprising the steps of mixing the following components:

a) about 1% micronized wax, b) about 66% water, c) about 20% organic solvent, d) about 1.5% emulsifier, and e) about 10% silicone liquid, spraying the cleaning mixture on an external surface of the vehicle; and wiping the cleaning mixture off the external surface of the vehicle.

20. A method for cleaning at least one surface of a vehicle of claim 19, additionally comprising the steps of:

spraying the cleaning mixture on an internal surface of the vehicle; and wiping the cleaning mixture off the internal surface of a vehicle.

21. A method for cleaning at least one surface of a vehicle of claim 19, additionally comprising in the step of mixing the components adding one of the group consisting of an effective amount of a preservative, a thickener, a fragrance, an ultraviolet light inhibitor and mixtures thereof.

22. A method for cleaning at least one surface of a vehicle comprising the steps of mixing the following components:

a) about 1% micronized wax, b) about 0.2% PTFE, c) about 0.2% carnauba wax, d) about 15% organic solvent, e) about 1% emulsifier, f) about 2.2% silicone liquid, and g) about 80.4% water, spraying the cleaning mixture on an external surface of the vehicle; and wiping the cleaning mixture off the external surface of the vehicle.

23. A method for cleaning at least one surface of a vehicle of claim 22, additionally comprising the steps of:

spraying the cleaning mixture on an internal surface of the vehicle; and wiping the cleaning mixture off the internal surface of a vehicle.

24. A method for cleaning at least one surface of a vehicle of claim 22, additionally comprising in the step of mixing the components adding one of the group consisting of an effective amount of a preservative, a thickener, a fragrance, an ultraviolet light inhibitor and mixtures thereof.

* * * * *